US010472135B2

(12) United States Patent
Wang

(10) Patent No.: US 10,472,135 B2
(45) Date of Patent: Nov. 12, 2019

(54) ANTI-GLUE OVERFLOW WET TISSUE BOX COVER

(71) Applicant: Top Green World Packaging Co., Ltd., Gelu (CN)

(72) Inventor: Ling-Da Wang, Gelu (CN)

(73) Assignee: Top Green World Packaging Co., Ltd., Gelu (CN)

( * ) Notice: Subject to any disclaimer, the term of this patent is extended or adjusted under 35 U.S.C. 154(b) by 89 days.

(21) Appl. No.: 15/856,809

(22) Filed: Dec. 28, 2017

(65) Prior Publication Data

US 2019/0077552 A1 Mar. 14, 2019

(30) Foreign Application Priority Data

Sep. 12, 2017 (CN) ..... 2017 2 1164719 U

(51) Int. Cl.
*B65D 43/16* (2006.01)
*A47K 10/32* (2006.01)

(52) U.S. Cl.
CPC ..... *B65D 43/163* (2013.01); *A47K 10/32* (2013.01); *B65D 43/16* (2013.01); *A47K 2010/3266* (2013.01); *B65D 2251/10* (2013.01); *B65D 2251/105* (2013.01); *B65D 2543/00101* (2013.01); *B65D 2543/00296* (2013.01); *B65D 2543/00453* (2013.01); *B65D 2543/00629* (2013.01); *B65D 2543/00759* (2013.01)

(58) Field of Classification Search
CPC ..... B65D 43/163; B65D 43/16; B65D 2251/105; B65D 2543/00629; B65D 2543/00101; B65D 2543/00759; B65D 2543/00453; B65D 2543/00296; B65D 2251/10; A47K 10/32; A47K 2010/3266
See application file for complete search history.

(56) References Cited

U.S. PATENT DOCUMENTS 1,513,860 A * 11/1924 Reutter ..... A45C 13/005 132/295
3,780,908 A * 12/1973 Fitzpatrick ..... A47K 10/421 206/205
3,836,044 A * 9/1974 Tilp ..... B65D 25/02 206/205
5,050,737 A * 9/1991 Joslyn ..... B65D 77/0453 206/494
5,931,336 A * 8/1999 Takeuchi ..... B60R 7/04 220/836
6,164,442 A * 12/2000 Stravitz ..... A45C 3/02 206/233

(Continued)

*Primary Examiner* — Kareen K Thomas
(74) *Attorney, Agent, or Firm* — Muncy, Geissler, Olds & Lowe, P.C.

(57) ABSTRACT

The utility model discloses an anti-glue overflow wet tissue box cover, comprising a cover body and an upper cover surface connected with the cover body. A glue overflow groove depressed upward is arranged on a lower surface of the cover body, and excessive overflow fixture flows into a means inside the glue overflow groove when the wet tissue box cover is fixed to a wet tissue bag with glue or other fixtures. The anti-glue overflow wet tissue box cover of the application has a simple structure and strong practicability, and the glue overflow groove thereon can effectively avoid overflow of solid glue when the wet tissue box cover is installed.

6 Claims, 5 Drawing Sheets

(56) References Cited

U.S. PATENT DOCUMENTS

| | | | | |
|---|---|---|---|---|
| 6,592,004 | B2 * | 7/2003 | Huang | B65D 83/0805 221/307 |
| 7,201,271 | B1 * | 4/2007 | Saad | A45C 11/00 132/315 |
| 7,614,519 | B2 * | 11/2009 | Krauth | B65D 43/169 220/262 |
| D625,913 | S * | 10/2010 | Phillips | D3/205 |
| 8,220,625 | B2 * | 7/2012 | Michaels | A45C 11/24 206/233 |
| D676,239 | S * | 2/2013 | Benoit | D3/294 |
| 2003/0221986 | A1 * | 12/2003 | Reinke | A47K 10/421 206/494 |
| 2005/0115855 | A1 * | 6/2005 | Hilel | A45C 11/008 206/440 |
| 2006/0054517 | A1 * | 3/2006 | Albert | B65D 21/0234 206/233 |
| 2007/0199841 | A1 * | 8/2007 | Mesalic | B65D 25/04 206/233 |
| 2007/0278227 | A1 * | 12/2007 | Damaghi | B65D 47/0871 220/254.5 |
| 2008/0001019 | A1 * | 1/2008 | Brown | A47K 10/3836 242/597.8 |
| 2010/0089935 | A1 * | 4/2010 | Heilman | B65D 47/0871 220/833 |
| 2011/0240514 | A1 * | 10/2011 | Bandoh | B65D 25/22 206/555 |
| 2013/0081364 | A1 * | 4/2013 | Piscopo | B65B 69/00 53/492 |
| 2016/0007812 | A1 * | 1/2016 | Yamada | B65D 83/0811 206/494 |
| 2016/0137392 | A1 * | 5/2016 | Yamada | B65D 25/22 206/494 |

* cited by examiner

ANTI-GLUE OVERFLOW WET TISSUE BOX COVER

TECHNICAL FIELD

The utility model relates to the packing field, in particular to an anti-glue overflow wet tissue box cover.

DESCRIPTION OF THE RELATED ART

Wet tissues are mainly used for daily skin cleaning and disinfection. For convenient carrying and keeping, wet tissues are generally placed in wet tissue boxes or wet tissue bags. And in order to take out wet tissues conveniently, wet tissue box covers are arranged on the wet tissue boxes or wet tissue bags for sealing. Wet tissue box covers are usually installed on wet tissue boxes or wet tissue bags by adhesives such as solid glue. However, when the solid glue is applied, the solid glue often overflows due to uncertain dosage of the glue, affecting the overall appearance of the wet tissue boxes or wet tissue bags.

SUMMARY OF THE UTILITY MODEL

For the problems in the prior art, the utility model provides an anti-glue overflow wet tissue box cover which can effectively avoid glue overflow, and effectively solve problems in the prior art.

The utility model solves the problems by the following technical solutions:

An anti-glue overflow wet tissue box cover, comprising a cover body and an upper cover surface connected with the cover body, and characterized in that a glue overflow groove depressed upward is arranged on a lower surface of the cover body.

Preferably, an open side is arranged on the upper cover surface, an extension portion extends downward an edge of the open side, a first clamping portion is arranged on the extension portion, a second clamping portion corresponding to the first clamping portion is arranged on the cover body, and the upper cover surface is closely clamped with the cover body through the first clamping portion and the second clamping portion.

Preferably, the extension portion extends toward an inner lower side from the upper cover surface, an outer surface of the extension portion forms an arc surface, and the first clamping portion is arranged inside the arc surface.

Preferably, the upper cover surface has an open side, a flap cover arranged obliquely toward an inner lower side of the upper cover surface is arranged at an edge of the open side, a first clamping portion is arranged inside a lower end of the flap cover, a second clamping portion elastically clamped with the first clamping portion is arranged on the cover body, and the upper cover surface is closely clamped with the cover body through the first clamping portion and the second clamping portion.

Preferably, the upper surface of the second clamping portion is a smooth bevel, and the lower surface thereof is a smooth plane; the side face of the first clamping portion in contact with the upper surface of the second clamping portion is a smooth bevel, and the upper surface thereof is a smooth plane.

Preferably, the lower surface of the second clamping portion keeps a 0.2 mm clearance from the upper surface of the first clamping portion after the flap cover and the cover body are closed.

Preferably, a connection portion is arranged at the outer edge of the cover body and the open side.

Preferably, the upper cover surface is integrated with the cover body.

The anti-glue overflow wet tissue box cover provided by the application has a simple structure and strong practicability, and the glue overflow groove on the lower surface thereof can effectively avoid overflow of glue, thus solving the problem of glue overflow when wet tissue box covers in the prior art are installed.

DESCRIPTION OF THE PREFERRED EMBODIMENT

The utility model will be described in detail in combination with preferred embodiments.

Embodiment 1

Figure 1:
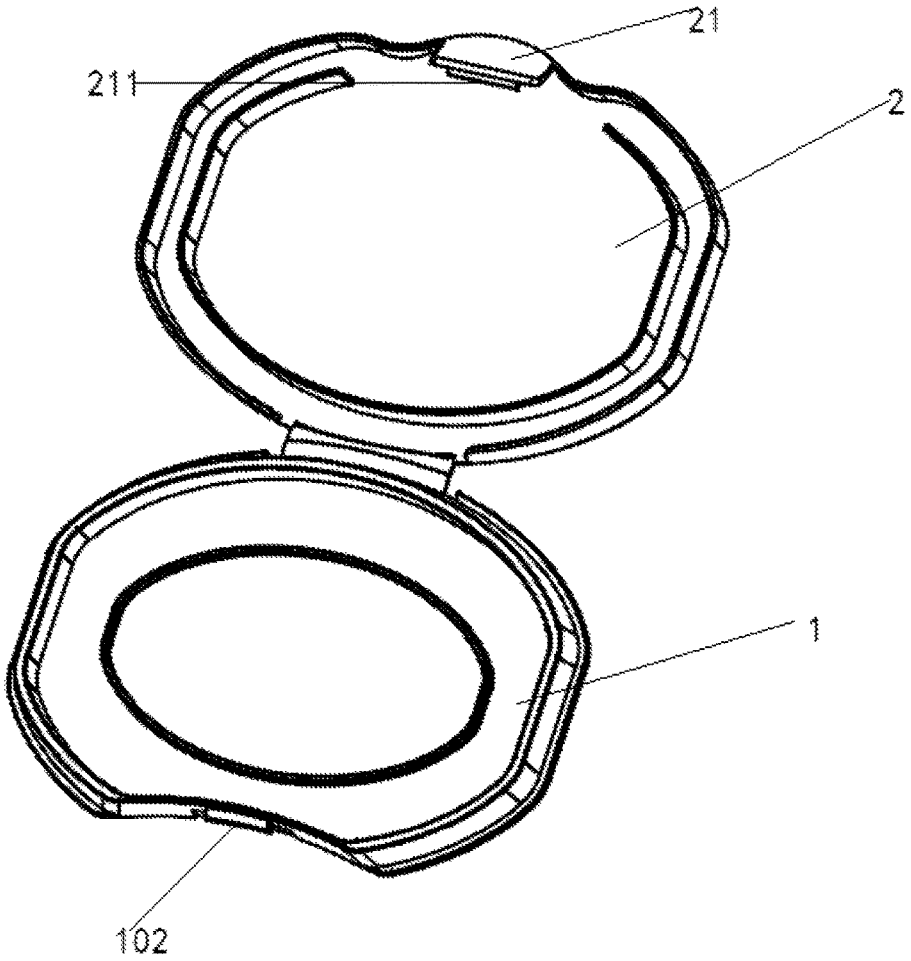
FIG. 1 is an unfolded schematic diagram of a first example of the application.
Figure 2:
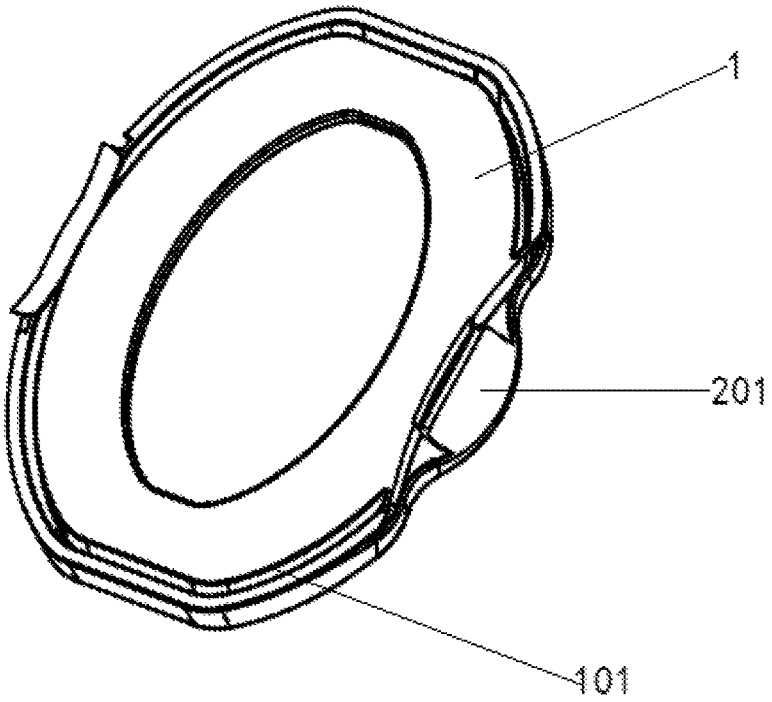
FIG. 2 is a rear view 1 of the first embodiment after closing.
Figure 3:
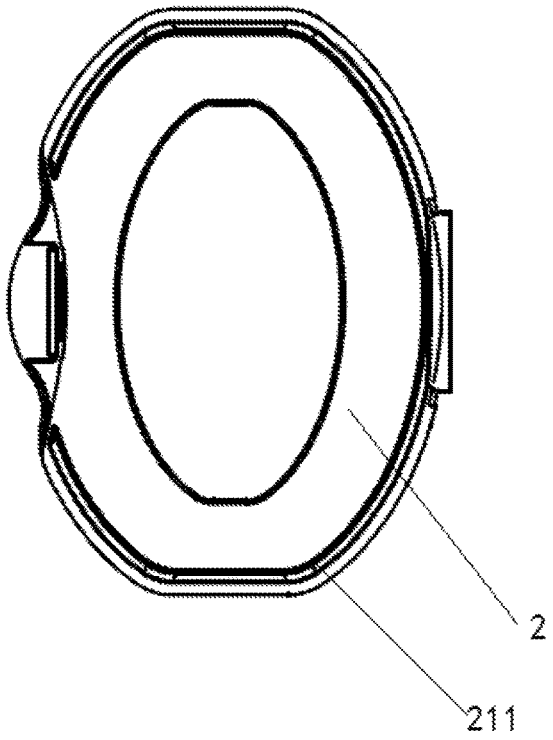
FIG. 3 is a rear view 2 of the first embodiment after closing.

As shown in FIG. 1 and FIG. 2, FIG. 1 is an unfolded schematic diagram of a first embodiment of the application; FIG. 2 is a rear view of the first embodiment after closing. An anti-glue overflow wet tissue box cover provided by the embodiment comprises a cover body 1 and an upper cover surface 2 connected with the cover body 1, a cavity is formed in the middle of the cover body 1, wet tissues can be taken out of the cavity when the a wet tissue box cover is installed on a wet tissue box, and an upper cover surface 2 is integrated with the cover body 1.

An open side is arranged on the upper cover surface 2, an extension portion 21 extends downward an edge of the open side, the extension portion 21 extends toward an inner lower side from the upper cover surface 2, an outer surface of the extension portion 21 forms an arc surface, a first clamping portion 211 is arranged on the extension portion 21, and the first clamping portion 211 is arranged inside the arc surface. A second clamping portion 102 corresponding to the first clamping portion 211 is arranged on the cover body 1, and the upper cover surface 2 is closely clamped with the cover body 1 through the first clamping portion 211 and the second clamping portion 102.

As shown in FIG. 2, a glue overflow groove 101 depressed upward is arranged on a lower surface of the cover body 1. When the box cover is installed on a wet tissue box or wet tissue bag with glue, glue applied to the lower surface of the cover body 1 overflows outside the cover body 1 into the glue overflow groove due to extrusion, avoiding overflow of glue.

Embodiment 2

Figure 4:
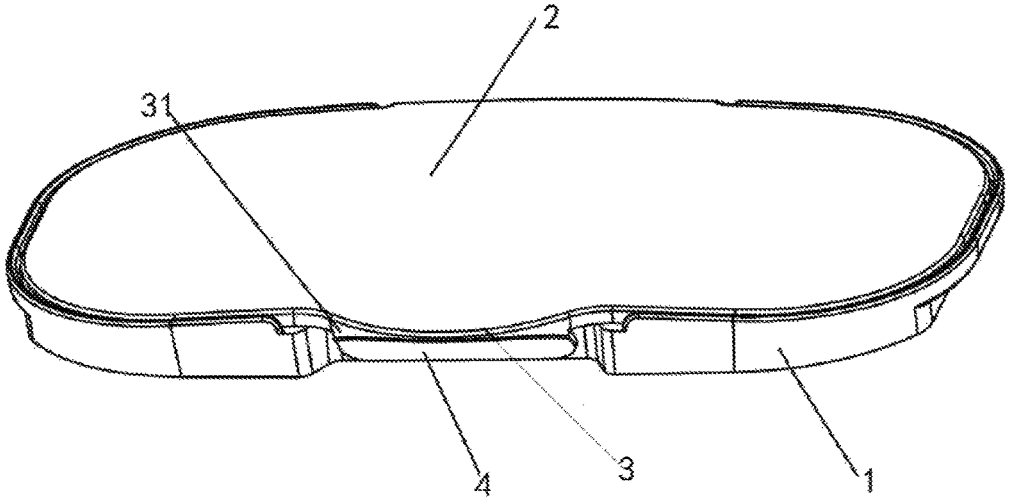
FIG. 4 is a perspective view of a second embodiment.

As shown in FIG. 4, FIG. 4 is a perspective view of a second embodiment. An anti-glue overflow wet tissue box cover provided by the embodiment comprises a cover body 1 and an upper cover surface 2 connected with the cover body 1, a cavity is formed in the middle of the cover body 1, wet tissues can be taken out of the cavity when the a wet tissue box cover is installed on a wet tissue box, and an upper cover surface 2 is integrated with the cover body 1.

Figure 5:
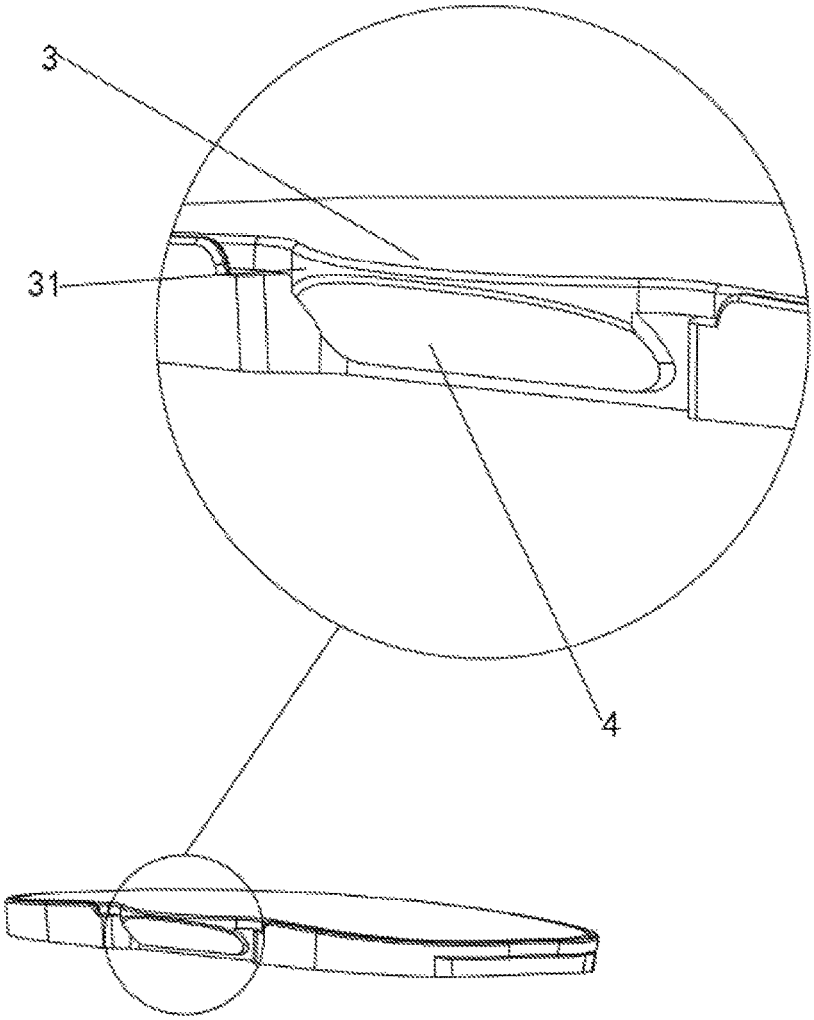
FIG. 5 is a local enlarged view of the second embodiment.
Figure 6:
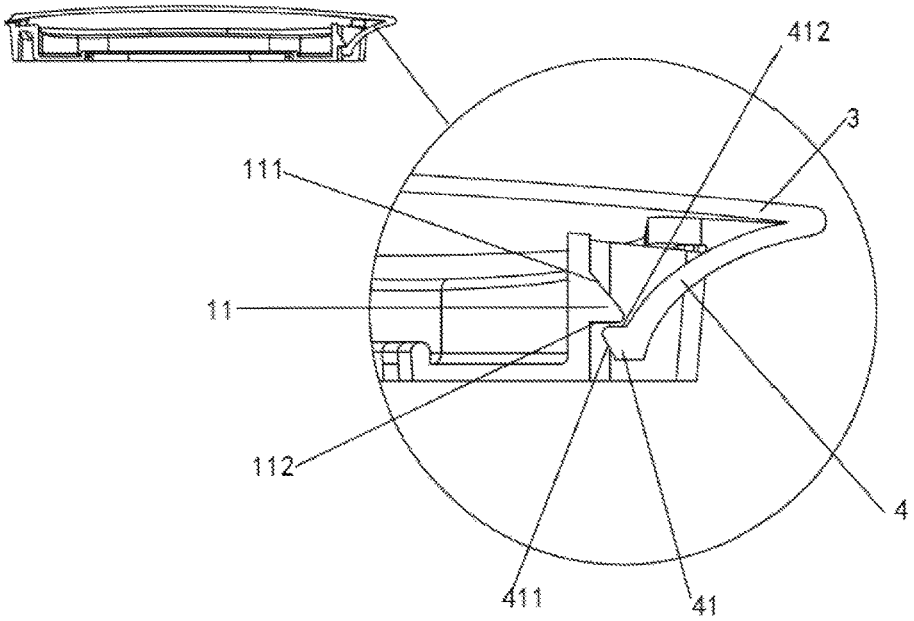
FIG. 6 is a sectional view and local enlarged view of the second embodiment.

As shown in FIG. 5 and FIG. 6, the upper cover surface 2 has an open side 3, a flap cover 4 arranged obliquely toward an inner lower side of the upper cover surface 2 is arranged at an edge of the open side 3, the flap cover 4 can be folded along an outer edge of the open side 3, a first clamping portion 41 is arranged inside a lower end of the flap cover 4, a second clamping portion 11 elastically clamped with the first clamping portion 41 is arranged on the cover body 1, the upper cover surface 2 is closely clamped with the cover body 1 through the first clamping portion 41 and the second clamping portion 11, and a connection portion 31 is arranged at the outer edge of the flap cover 4 and the open side 3.

As shown in FIG. 6, the upper surface 111 of the second clamping portion 11 is a smooth bevel, and the lower surface 112 thereof is a smooth plane; the side face 411 of the first clamping portion 41 in contact with the upper surface of the second clamping portion is a smooth bevel, and the upper surface 412 thereof is a smooth plane; during clamping, the side face 411 of the first clamping portion is in contact with the upper surface 111 of the second clamping portion under pressure, and then slides downward along the upper surface 111 of the second clamping portion, the flap cover 4 is sprung up outward due to elasticity of the material during sliding, the second clamping portion 11 gets into the upper part of the first clamping portion 41, and then the flap cover 4 recovers the original elasticity.

The lower surface 112 of the second clamping portion keeps a 0.2 mm clearance from the upper surface 412 of the first clamping portion after the flap cover 4 and the cover body 1 are closed. The 0.2 mm clearance allows recovery of elasticity of the material, preventing reduced service life due to overstretch of the first clamping portion 41 and the second clamping portion 11 for service environment and other factors, and the clearance facilitates the operation to separate the flap cover 4 from the cover body 1, so that the first clamping portion 41 is not closely connected with the second clamping portion 11, and thus can be opened conveniently.

The lower surface of the cover body 1 in the embodiment is the same as that in the first embodiment, and a glue overflow groove 101 depressed upward is arranged. When the box cover is installed on a wet tissue box or wet tissue bag with glue, glue applied to the lower surface of the cover body 1 overflows outside the cover body 1 into the glue overflow groove, avoiding overflow of glue.

In the application, the upper cover surface 2 is clamped with the cover body 1 or the acting point is on the extension portion or the flap cover 4 when the upper cover surface 2 is separated from the cover body 1 in the first embodiment and the second embodiment, avoiding scratching fingers.

It should be understood that such embodiments are only used to describe but not limit the scope of the invention. It should be also understood by those skilled in the art that various changes or modifications can be made to the utility model after reading the contents taught by the utility model, and the equivalent forms also fall into the scope defined by claims attached to the application.

The invention claimed is:

1. An anti-glue overflow wet tissue box cover, comprising a cover body and an upper cover surface connected with the cover body, wherein a glue overflow groove depressed upward is arranged on a lower surface of the cover body, wherein an open side is arranged on the upper cover surface, an extension portion extends downward an edge of the open side, a first clamping portion is arranged on the extension portion, a second clamping portion corresponding to the first clamping portion is arranged on the cover body, and the upper cover surface is closely clamped with the cover body through the first clamping portion and the second clamping portion, wherein the extension portion extends toward an inner lower side from the upper cover surface, an outer surface of the extension portion forms an arc surface, and the first clamping portion is arranged inside the arc surface.

2. The anti-glue overflow wet tissue box cover according to claim 1, wherein the upper cover surface has the open side, a flap cover arranged obliquely toward the inner lower side of the upper cover surface is arranged at an edge of the open side, the first clamping portion is arranged inside a lower end of the flap cover, the second clamping portion elastically clamped with the first clamping portion is arranged on the cover body, and the upper cover surface is closely clamped with the cover body through the first clamping portion and the second clamping portion.

3. The anti-glue overflow wet tissue box cover according to claim 2, wherein an upper surface of the second clamping portion is a smooth bevel, and a lower surface thereof is a smooth plane; a side face of the first clamping portion in contact with the upper surface of the second clamping portion is a smooth bevel, and an upper surface thereof is a smooth plane.

4. The anti-glue overflow wet tissue box cover according to claim 2, wherein the lower surface of the second clamping portion keeps a 0.2 mm clearance from the upper surface of the first clamping portion after the flap cover and the cover body are closed.

5. The anti-glue overflow wet tissue box cover according to claim 2, wherein a connection portion is arranged at an outer edge of the cover body and the open side.

6. The anti-glue overflow wet tissue box cover according to claim 1, wherein the upper cover surface is integrated with the cover body.

* * * * *